US009017131B1

(12) United States Patent
Vandenheuvel

(10) Patent No.: US 9,017,131 B1
(45) Date of Patent: Apr. 28, 2015

(54) HAND MANIPULATED CONSTRUCTION VEHICLE TOY

(71) Applicant: Ernest Autumn Vandenheuvel, Congers, NY (US)

(72) Inventor: Ernest Autumn Vandenheuvel, Congers, NY (US)

( * ) Notice: Subject to any disclaimer, the term of this patent is extended or adjusted under 35 U.S.C. 154(b) by 20 days.

(21) Appl. No.: 14/055,541

(22) Filed: Oct. 16, 2013

(51) Int. Cl.
*A63H 33/32* (2006.01)
*A63H 33/30* (2006.01)

(52) U.S. Cl.
CPC ..... *A63H 33/30* (2013.01)

(58) Field of Classification Search
USPC ..... 446/26, 70, 396, 404, 424–428
See application file for complete search history.

(56) References Cited

U.S. PATENT DOCUMENTS

| | | | | | |
|---|---|---|---|---|---|
| 2,523,093 | A * | 9/1950 | Byrne | 414/694 |
| 3,393,469 | A * | 7/1968 | Balthazor | 446/426 |
| 3,453,774 | A * | 7/1969 | Gruber et al. | 446/353 |
| 4,712,968 | A * | 12/1987 | Manning | 414/694 |
| D322,099 | S * | 12/1991 | Mast | D21/419 |
| 5,286,228 | A * | 2/1994 | Lee et al. | 446/26 |
| D419,623 | S * | 1/2000 | Lee et al. | D21/658 |
| 7,347,763 | B2 * | 3/2008 | Ewringmann | 446/427 |
| 7,976,356 | B2 * | 7/2011 | Bruder | 446/434 |
| 2002/0105182 | A1 * | 8/2002 | Huntsberger et al. | 280/827 |

* cited by examiner

*Primary Examiner* — Kurt Fernstrom
(74) *Attorney, Agent, or Firm* — Richard A. Joel, Esq

(57) ABSTRACT

This invention relates to hand manipulated toy construction equipment such as backhoes, trucks, etc. In one embodiment, the truck body is hollow at one end so that the truck may be manipulated by inserting one's arm into the truck body and grasping and manipulating a transverse dowel handle. Spring-loaded means are provided within the truck body and are coupled to the dumper to control the motion of the equipment. A sound module is also provided to simulate construction sounds.

9 Claims, 3 Drawing Sheets

HAND MANIPULATED CONSTRUCTION VEHICLE TOY

CROSS REFERENCE TO RELATED APPLICATIONS

This application is a continuation of application Ser. No. 12/786,971 filed May 25, 2010

STATEMENT REGARDING FEDERALLY SPONSORED RESEARCH OR DEVELOPMENT

Not Applicable

PARTIES TO A JOINT RESEARCH AGREEMENT

Not Applicable

DESCRIPTION

1. Field of the Invention

This invention relates to toys such as trucks, backhoes, and bulldozers and particularly to hand manipulated trucks and other construction equipment.

2. Background of the Invention

Toy trucks, bulldozers, backhoes and other construction equipment have been quite popular with children as playthings particularly in a beach environment. This invention enhances a toy truck and other construction equipment as a plaything by making it an interactive toy. A sleeve or arm is connected to the truck in one embodiment so that the truck may be hand manipulated by inserting one's arm into the sleeve and grasping a simple dowel handle. Spring-loaded means may be provided within the sleeve to control the motion of a backhoe, bulldozer, scraper, etc. A sound module is also provided to simulate construction sounds.

Children of all ages are fascinated by big machines such as bulldozers, trucks and other heavy equipment. This can be evidenced by bulldozer videos produced for kids markets that achieve high sales figures year in and year out.

Some children even grow up and become construction workers and construction equipment operators. Many children are intrigued by the size and power of these specialized earth moving machines and equipment. Children often state they want to be a "bulldozer guy" and move mountains of dirt, rock, and mud or drive really big trucks that haul earth and other material. These machines and the people who operate them seem to fire a child's imagination resulting in many hours of interactive imaginary beach and sandbox play.

From time immemorial, humankind has built with their hands, shelter, roads, pyramids farms for food and much more. The earliest man first created simple hand tools such as hammers, shovels and more to help him realize his dreams of accomplishment.

The simplest tools helped man produce great works of efficiency, using just his hands. As time went on man become more creative and technical, creating giant machines capable of doing the earth work of one hundred men in a mere day's time; digging foundations, clearing land, digging tunnels, leveling mountains, planting fields and retrieving the bounty of the earth.

Today's construction machinery is more highly advanced than anything before it and is able to do the work of many, many men and yet it is still designed to accomplish the simplest of tasks, to move earth, rock, and mud. You now have one man/one machine—simple, yet technical and absolutely fascinating to watch and observe. Children want to attach to that simple power, the power to build with one's hands.

The simple toy device disclosed herein shrinks that awesome bulldozer power down to kid size imaginatively allowing the child to actually "become the bulldozer, dumper, and the crew or boss". A child learns best when they are emotionally attached to a skill.

Bulldozer operators are a highly skilled group, artisans with machinery performing a "slow motion steel ballet". The U.S. construction industry is a $117 billion dollar per year industry with 23 million employees and growing. This industry promotes within itself and is constantly seeking its next generation workforce.

This toy device is designed to set a child's imagination free. A miniature bulldozer, truck, or backhoe that the child "gets into" by wearing and operating it just like the real thing, but sized just for them, for beach and sandbox usage. This device will allow a child to team up with other users and become part of a crew or even imaginatively operate two different bulldozers at once and then switch off to a truck. A child digging in the sand harkens back to earliest mankind, building with his or her hands. A child's play time imagination is unleashed in this imaginative toy.

This toy allows children to really "get down in the dirt" and mimic real adult bulldozer action and maneuvering. Imaginary fascination comes to life as child becomes "one with the machine" possibly resulting in hours of imaginative playtime on beaches and sandboxes.

DESCRIPTION OF RELATED ART INCLUDING INFORMATION DISCLOSED UNDER 37 CFR 1.97 & 1.98

In the prior art, U.S. Pat. No. 4,449,322 to Blumenthal and his design patent Des. 288,455 are of general interest in this area. Other patents of interest include U.S. Pat. No. 3,453,774 to Brenerman; U.S. Pat. No. 4,756,703 to Kennedy; U.S. Pat. No. 5,316,514 to Ellman and Des. 419,623 to Lee. Other patents of interest directed to specific features included U.S. Pat. No. 6,236,305 to Martin and U.S. Pat. No. 6,699,096 to Christopherson. Applicant, however, provides a unique interactive construction toy which is not disclosed in the prior art. This toy is appealing to children as they simulate construction activities.

SUMMARY OF INVENTION

A hand actuated toy truck or other toy construction equipment comprises a plastic body and an attached sleeve with an opening that accommodates the user's arm or hand to provide an interactive plaything. The user grips a handle or a moveable spring-loaded member within the sleeve or opening to actuate a bucket, dumper, scraper, etc., in a truck, backhoe, bulldozer, etc. A sound module may be mounted on the sleeve or opening with a connected battery pack in a latchable compartment. A push button control activates the sound module to provide various construction sounds and noises.

Accordingly, an object of this invention is to provide a new and improved construction toy.

Another object of this invention is to provide a new and improved hand manipulated toy truck or other toy construction equipment.

A further object of this invention is to provide a new and improved toy truck that is hand manipulated to perform various imaginary construction operations.

A still further object of this invention is to provide new and improved hand manipulated toy construction equipment that emits construction sounds when activated.

A more specific object of this invention is to provide new and improved toy construction equipment that is hand manipulated through an attached sleeve or opening by grasping a transverse dowel or handle, which interacts with a spring-loaded coupling. The equipment further includes a sound module for simulating construction sounds while imparting educational knowledge to the user. Thus, children learn how such equipment works and how to build with such equipment. The invention is also useful as a learning tool in the field of earth sciences. A hand manipulated toy truck or other construction equipment comprises a plastic body and an attached sleeve that is wrapped around the user's arm to provide an interactive plaything. The user grips a handle or a spring-loaded member within the sleeve to actuates a pivotal shovel, dumpster, scraper, etc., in a truck, backhoe, bulldozer, etc. A sound module may be mounted in a compartment on the sleeve with a connected battery pack. A button control activates the sound module to provide various construction sounds and noises.

BRIEF DESCRIPTION OF DRAWINGS

The above and other objects of this invention may be more clearly seen when viewed in conjunction with the accompanying drawings wherein.

DETAILED DESCRIPTION OF THE INVENTION

Figures 1A, 1B:
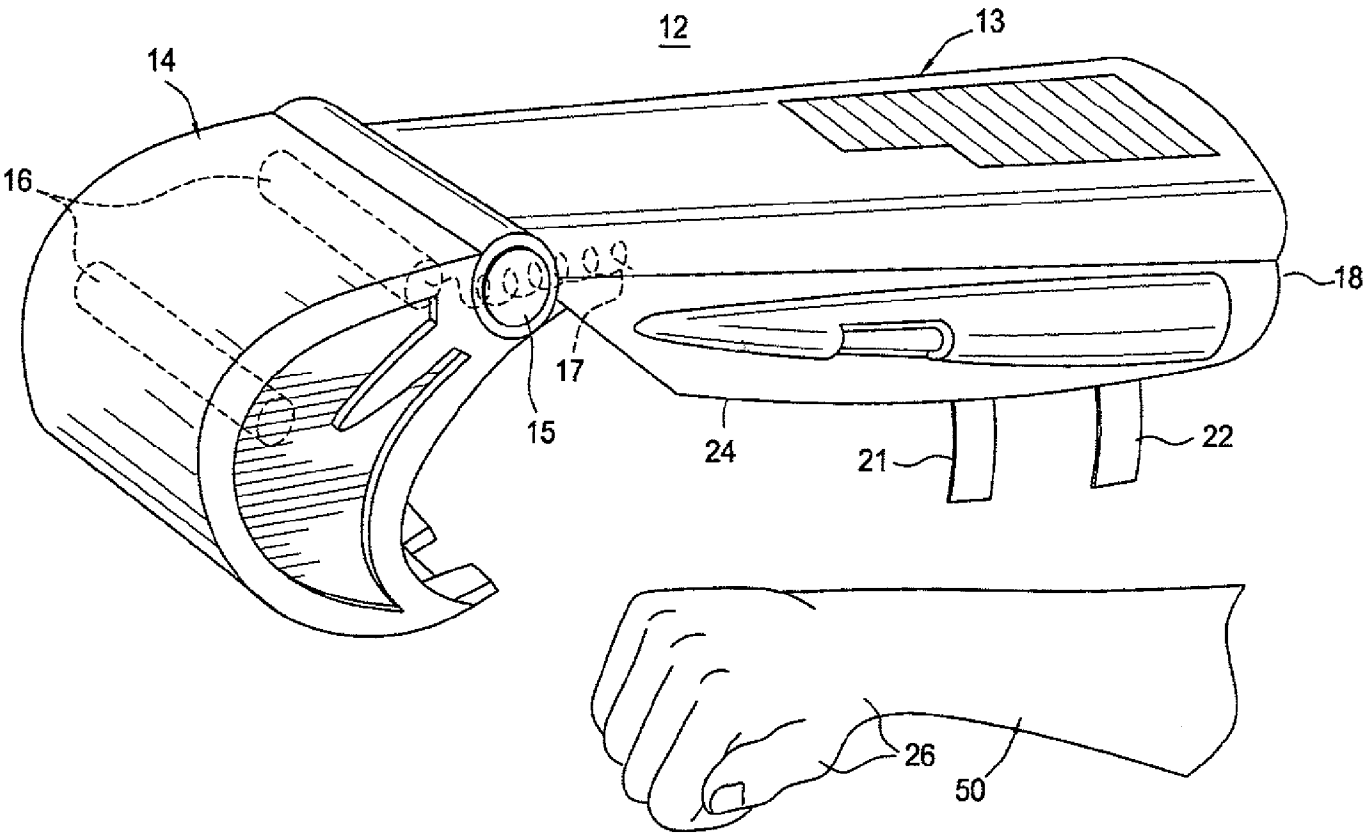
FIG. 1*a* is a perspective view of a toy backhoe embodiment of the invention showing a backhoe dipper stick and bucket.
FIG. 1B is a view of the arm which actuates the backhoe with the motion indicated by arrows.

Referring now to the drawings, this invention relates to hand manipulated construction equipment for children. FIG. 1*a* shows a backhoe 12 embodiment of the invention. The backhoe 12 comprises a hollow sleeve 13 having a pivotal bucket 14 mounted to the sleeve 13 with the hinge 15 and includes a transverse dowel or handle 16 (shown in phantom) which the user grasps.

A spring 17 is mounted to the bucket 14 and sleeve 13 at its opposite ends to return the bucket to an open position when not actuated.

In use, a child inserts his arm 50 into the opening 18 in the sleeve 13 and grasps the dowel handle 16 in the bucket 14. The sleeve 13 includes an axial slot 24 having fastening members 21, 22 to secure the sleeve about the user's arm 50.

To dump the earth or sand, the dowel handles 16 is pushed away with the user's wrist action on the sleeve 13 under the urging of spring 17. Alternatively, the spring 17 may be omitted and the bucket 14 pivotally attached to hinges (not shown) and the user returns the backhoe 12 to its original position manually. To release the backhoe 12 the child merely lets go of the dowel handle 16. The handle 16 is integrally molded with the bucket 14 while the sleeve 13 is a separate molding, pivotally attached to the bucket 14. The sleeve 14 may include merely an opening, or a lower open portion having hook and loop fasteners 21 and 22.

Figure 2:
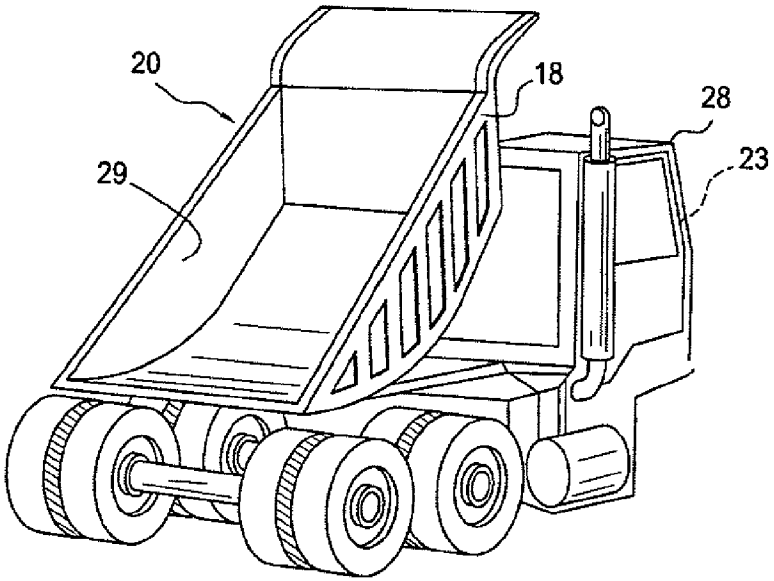
FIG. 2 is a perspective view of a toy truck embodiment of the invention.

FIG. 2 depicts a truck embodiment of the invention. The truck 20 includes a cab 28 and a dumper 29 which pivots upwardly to dump a load. An opening 23 in the cab 21 leads to a dowel handle (not shown) in the dumper 29. To operate, a user's hand pulls the internal dowel handle towards the user causing the dump body 29 to raise and dump the sand or dirt into the body 29. When the user releases the handle the dump body 29 lowers under the spring action and is ready to load with sand or dirt again.

Figure 3:
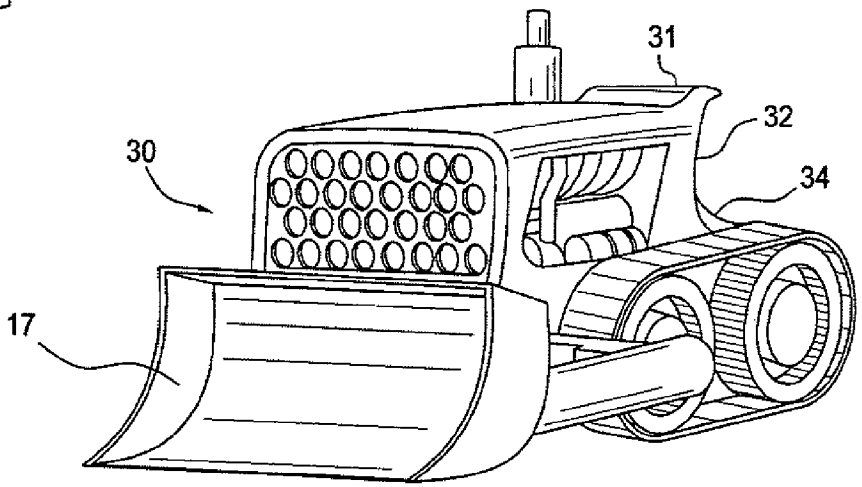
FIG. 3 is a perspective view of a toy bulldozer embodiment of the invention.

FIG. 3 illustrates a bulldozer embodiment of the invention. The bulldozer 30 includes a cabin or operator seat 31 with an internal sleeve opening 32. A dowel handle (not shown) is mounted transversely within the sleeve 34. Grasping the transverse dowel handle (not shown) and pushing downwardly raises the scraper blade 35 which is connected to flanges 36. The flanges 36 include transverse apertures to accommodate the handle. On the other hand, letting off on the handle (not shown) causes the scraper blade 35 to lower into a ready push position. The insertion of the child's arm into the sleeve 34 makes the toy interactive as an extension of the user's arm.

Figure 4:
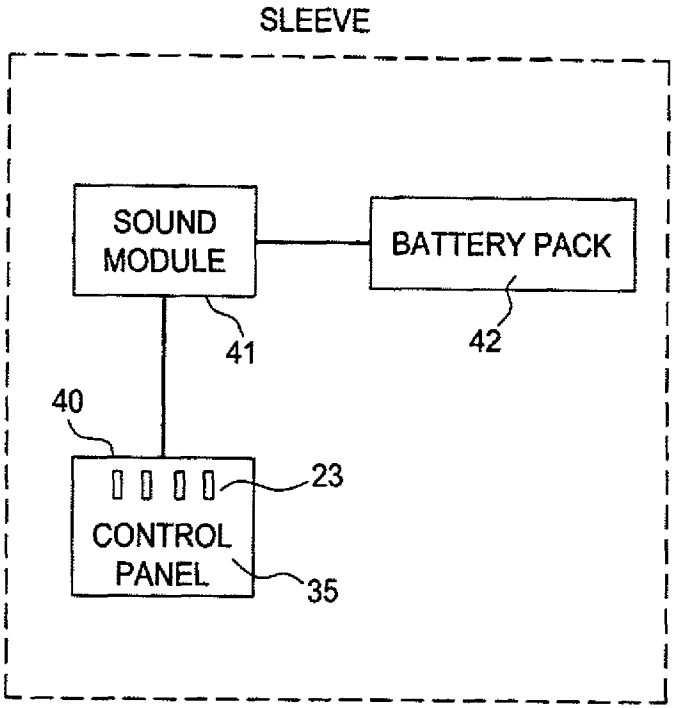
FIG. 4 is a schematic view of the sound module and cooperating elements.

As shown in FIG. 4, a push button control panel 40 having a plurality of buttons 43 for various sounds activates a sound module 41 powered by a battery pack 42. The module 41 contains a plurality of vehicle and worker sounds and is mounted in a latchable compartment to the various sleeves 13, etc., to produce the sounds that the child determines by pushing a particular button While the invention has been explained by a detailed description of certain specific embodiments, it is understood that various modifications and substitutions can be made in any of them within the scope of the appended claims, which are intended also to include equivalents of such embodiments. For example, the invention may be made of plush or foam or wood for small children and the size of the construction equipment sized accordingly. On the other hand, the equipment can be made of plastic or wood for older children.

What is claimed is:

1. A hand-manipulated toy simulating construction equipment comprises:

a main equipment body portion having a first and a second end portion including a hollow pivotal portion at the second end portion;

a hinge joining the first and second end portions;

a hollow sleeve mounted to the main body portion at the first end portion for the insertion of one's hand through the sleeve into the hollow second end pivotal portion;

a dowel handle transversely located internally within the sleeve and molded to the hollow pivotal portion to be grasped by one's hand to manually actuate said portion in a pivotal motion; and, wherein the toy simulates construction equipment by digging with the curved pivotal portion.

2. A hand manipulated toy in accordance with claim 1 further including:

a latchable compartment mounted on the sleeve;

a sound module mounted in the latchable compartment; and, a push button control panel mounted externally on the sleeve and coupled to said module to activate the sound module to emit construction noises.

3. A hand manipulated toy in accordance with claim 1 further including:

spring means mounted to the curved pivotal portion of the toy and to the sleeve which permits the curved pivotal portion to return to its original unactuated position after operation; and, the hollow pivotal portion includes an outer end having a series of teeth dig sand into the curved body portion.

4. A hand manipulated toy in accordance with claim 1 wherein:

the construction equipment body portion comprises a miniature scale truck body and cab having a hinge, a pivotal dumper connected to the hinge and pivoting upon the main equipment body at the hinge mounted thereto and said dumper being hand manipulated by the movement of an internal molded dowel handle and the sleeve comprises a hollow truck cab mounted at one end of the body, said cab having an opening for insertion of one's hand to contact the dowel handle.

5. A hand manipulated toy in accordance with claim 1 wherein:

the construction equipment body comprises a miniature scale backhoe dipper stick having a pivotal bucket mounted thereto at one end and manipulated via hand/wrist movement of the dowel handle.

6. A hand manipulated toy in accordance with claim 1 wherein:

the construction equipment body comprises a miniature scale bulldozer having a cabin sleeve including an aperture and a transverse internal dowel handle and a hollow movable scraper body mounted to the sleeve which is accessed through the cabin to be manipulated via hand/wrist movement of the dowel handle.

7. A hand manipulated toy in accordance with claim 1 further including:

wherein the sleeve includes an opening extending axially therealong to accommodate the user's arm; and, fastening means attached to the sleeve to secure said sleeve about one's arm.

8. A hand manipulated toy in accordance with claim 7 wherein:

the sleeve comprises a substantially cylindrical member having an axial slot including opposing edges and fastening members being mounted on one edge and fastening means on the other edge engaged by the fastening members for fastening purposes.

9. A hand manipulated toy simulating construction equipment comprises:

a scraper blade having a main vertical portion, having a front face and rear face, a curved bottom portion, a side wall portion on each side of the vertical portion;

a pair of spaced flanges extending outwardly from the rear face of the vertical portion, said flanges each having a transverse aperture extending therethrough, and a handle extending between the flanges and being mounted at each end to a respective flange;

a sleeve having circumferential walls comprising upper and lower wall portions and opposite side wall portions joining the blade and lower wall portions and an aperture extending therethrough for access by a user's arm and a projection on each side wall portion each to engage a respective aperture in a flange to permit pivotal motion of the scraper blade, wherein;

one can manipulate the scraper blade by inserting one's arm through the sleeve to grip the handle for control purposes.

* * * * *